US011864624B2

(12) United States Patent
Smith et al.

(10) Patent No.: US 11,864,624 B2
(45) Date of Patent: Jan. 9, 2024

(54) FOOTWEAR AND SOLES THEREOF

(71) Applicant: Bionic Muscle LLC, Farmingdale, NY (US)

(72) Inventors: Christopher D. Smith, Ronkonkoma, NY (US); Anthony Loconte, Alpine, NJ (US); Evan R. Jones, Levittown, NY (US); Allan Katz, Farmingdale, NY (US); Lawrence Rabinowitz, Alpine, NJ (US)

(73) Assignee: Bionic Muscle LLC, Farmingdale, NY (US)

( * ) Notice: Subject to any disclaimer, the term of this patent is extended or adjusted under 35 U.S.C. 154(b) by 85 days.

(21) Appl. No.: 17/503,445

(22) Filed: Oct. 18, 2021

(65) Prior Publication Data

US 2022/0117355 A1 Apr. 21, 2022

Related U.S. Application Data

(60) Provisional application No. 63/093,389, filed on Oct. 19, 2020.

(51) Int. Cl.
*A43B 13/18* (2006.01)
*A43B 3/24* (2006.01)

(52) U.S. Cl.
CPC ..... *A43B 13/18* (2013.01); *A43B 3/246* (2013.01); *A43B 13/181* (2013.01)

(58) Field of Classification Search
CPC ..... A43B 21/437; A43B 13/18; A43B 13/181; A43B 3/246; A43B 3/26
USPC ..... 36/29
See application file for complete search history.

(56) References Cited

U.S. PATENT DOCUMENTS

| | | | | |
|---|---|---|---|---|
| 4,858,338 | A | 8/1989 | Schmid | |
| 5,311,680 | A * | 5/1994 | Comparetto | A43B 7/1435 36/43 |
| 5,666,746 | A * | 9/1997 | Pollard | A43B 5/185 36/97 |
| 6,237,255 | B1 * | 5/2001 | Renaudin | A43B 3/26 36/97 |
| 6,944,972 | B2 | 9/2005 | Schmid | |
| 7,105,607 | B2 | 9/2006 | Chen | |
| 8,984,775 | B2 | 3/2015 | Dombrow et al. | |
| 9,241,535 | B2 * | 1/2016 | Baudouin | A43B 13/141 |
| 10,485,294 | B2 * | 11/2019 | Schneider | A43B 13/184 |
| 2001/0007177 | A1 | 7/2001 | Brown, Jr. et al. | |
| 2006/0065499 | A1 * | 3/2006 | Smaldone | F16F 7/00 267/141 |

(Continued)

FOREIGN PATENT DOCUMENTS

KR 10-2009-0036854 A 4/2009

*Primary Examiner* — Marie D Bays
(74) *Attorney, Agent, or Firm* — Collard & Roe, P.C.

(57) ABSTRACT

A sole for footwear includes an elongate body and a plurality of discrete, flexible and inserts configured to be secured to the elongate body. The insert has an elongate main portion fabricated from an elastic material and having a first end portion and a second end portion, a first anchor attached to the first end portion of the elongate main portion and configured to detachably engage a sole and a second anchor attached to the second end portion of the elongate main portion and configured to detachably engage a sole. The anchors can be secured in notches in a cavity of the sole to securely attach the insert to the sole.

15 Claims, 7 Drawing Sheets

(56) References Cited

U.S. PATENT DOCUMENTS

| | | | | |
|---|---|---|---|---|
| 2006/0162193 | A1* | 7/2006 | Jones | A43B 21/42 36/136 |
| 2007/0119074 | A1* | 5/2007 | Aveni | A43B 21/26 36/27 |
| 2009/0126224 | A1* | 5/2009 | Greene | A43B 13/186 36/35 R |
| 2011/0214311 | A1* | 9/2011 | Stonisch | A43B 3/242 36/15 |
| 2011/0214313 | A1* | 9/2011 | James | A43B 13/14 36/103 |
| 2012/0096746 | A1* | 4/2012 | Lee | A43B 1/0018 36/25 R |
| 2013/0326911 | A1* | 12/2013 | Baucom | A43B 13/26 36/103 |
| 2014/0259747 | A1* | 9/2014 | Baudouin | A43B 13/141 36/28 |
| 2014/0366401 | A1* | 12/2014 | Cavaliere | A43B 5/00 36/103 |
| 2017/0164682 | A1* | 6/2017 | Pianta | A43B 3/12 |
| 2017/0340056 | A1* | 11/2017 | Bunnell | A43B 13/12 |
| 2018/0140043 | A1* | 5/2018 | Farris | A43B 3/246 |

* cited by examiner

FOOTWEAR AND SOLES THEREOF

CROSS-REFERENCE TO RELATED APPLICATIONS

This application claims priority under 35 USC 119(e) from U.S. Provisional Application Ser. No. 63/093,389, filed on Oct. 19, 2020, the disclosure of which is herein incorporated by reference.

BACKGROUND OF THE INVENTION

1. Technical Field

The present invention relates to footwear, and more particularly, to soles of athletic footwear. In particular, the invention relates to footwear having a built-in or removable support element that approximates the human anatomy.

2. Background of Related Art

Footwear, such as running shoes, generally include a foot housing portion supported on a sole assembly, which is flexible and typically includes a ground-engaging outsole, a midsole consisting of highly resilient material, and an innersole received in the foot housing portion and disposed on the midsole. The midsole of athletic shoes is typically formed of an elastic material for absorbing impact associated with movement of the user's foot and then springing back to its original shape to return the energy to launch a runner forward.

Currently, there are many different types of running or athletic shoes that attempt to provide cushioning from impact and comfort for all phases of activity to suit all types of running styles and physiologically distinct feet. However, there is a continued need for footwear that is comfortable, capable of absorbing and returning stored energy during various phases of a walking or running cycle, aesthetically pleasing, and customizable by the user to suit various types of feet and needs of the user. In order to compensate for shoes that do not meet the support needs of customers, the use of separate insoles and orthotic devices, both custom and over-the-counter, are commonly used. These insoles replace the standard insole that is sold with the shoe, and can provide additional support and/or cushioning to different parts of the foot. However, these devices tend to be formed from a single rigid planar element that is bent or formed into the desired shape or is thickened in portions. These types of devices are not configured to move or change shape during use, and cannot always compensate for changes in the foot anatomy while the user is wearing the footwear.

SUMMARY OF THE INVENTION

It is therefore an object of the invention to provide a sole for footwear that provides a dynamic support that approximates and strengthens the natural foot anatomy.

This object is accomplished by a sole for footwear that comprises an elongate body and an insert formed by an elastic, elongate element configured to be secured to the elongate body. The elongate body has a heel portion, a toe portion, and an intermediate portion disposed between the heel and toe portions.

The insert may include a proximal end portion, a distal end portion, and a main portion disposed between the proximal and distal end portions. The proximal end portion may be configured to secure to the intermediate portion of the elongate body adjacent the heel portion of the elongate body. The distal end portion may be configured to secure to the intermediate portion of the elongate body adjacent the toe portion of the elongate body.

The main portion of the insert may be more elastic than the proximal and distal end portions. The proximal and distal end portions may be fabricated from a rigid material, and the main portion may be fabricated from an elastic material. The elastic material of the main portion may be an elastomer or rubber, and the rigid material may be a metal or a plastic. Alternatively, the material of the distal and proximal end portions may extend all the way through the main portion, which then may have a covering or coating of a different material to provide additional support and/or cushioning. In this case, the material of the insert may be one that is able to stretch and deform in response to movement of the foot, but is sufficiently rigid that the proximal and end portions are secured within the elongate body even under large amounts of force, such as during running or other sports. Suitable base materials for this embodiment can be any type of metal, such as spring steel, or plastic, (ABS/Polypropylene/Polyethylene) or a composite, such as a carbon fiber matrix in resin, or bundles of elastomer fibers to allow stretch in the long axis. Suitable materials for the covering portion can be any type of TPU (Thermoplastic polyurethane), TPV (Thermoplastic Vulcanate), TPE (Thermoplastic Elastomer), Silicone, and/or any suitable rubber compound (NR, SBR, IIR, NBR, CR, EPDM). The covering should be soft enough to be comfortable underfoot, and can be completely enclosed within the sole.

The intermediate portion of the elongate body may define a cavity, and the main portion of the first elastic, elongate element may span the cavity. The intermediate portion of the elongate body may define a proximal notch therein and a distal notch therein. The proximal end portion of the insert may be configured for removable receipt in the proximal notch, and the distal end portion of the insert may be configured for removable receipt in the distal notch. The insert may be configured for a friction-fit engagement with the proximal notch, and the distal end portion of the insert may be configured for a friction-fit engagement with the distal notch. The proximal and distal notches keep the insert secured within the sole.

The insert may be parallel with a longitudinal axis defined by the elongate body, or it may be arranged at an oblique angle, depending on the needs of the user.

The elongate body may have a lateral side defining a window in the intermediate portion so that the first elastic elongate element is visible through the window. The underside of the elongate body may also have a window therein, so that the elongate body is visible from underneath the footwear as well.

The sole may further include a second insert configured to be secured to the elongate body. The first and second inserts may extend longitudinally along the elongate body and parallel with one another or may be arranged at different angles with respect to each other. Additional inserts may also be added, depending on the desired functionality and appearance of the footwear. The several inserts may be of different lengths and may be arranged at different angles with respect to each other, to provide support to different portions of the foot anatomy.

The elongate body may prevent relative axial movement of the insert when the insert is secured to the elongate body.

The invention also relates to the insert itself or a plurality of inserts for footwear that includes an elongate main portion, a first anchor, and a second anchor. The elongate main portion is fabricated from an elastic material and has a first end portion and a second end portion. The first anchor is attached to the first end portion of the elongate main portion and configured to detachably engage a sole. In aspects, the second anchor is attached to the second end portion of the elongate main portion and configured to detachably engage a sole.

The first and second anchors may be fabricated from a rigid material, such as metal or plastic, and the elastic material of the main portion may be an elastomer or rubber. The elongate main portion may include a bundle of elongate fibers. Alternatively, the anchors and main portion may be formed of a unitary body of a rigid or elastic material, and the main portion may then have a covering of a different material to provide additional support or cushioning.

As used herein, the terms parallel and perpendicular are understood to include relative configurations that are substantially parallel and substantially perpendicular up to about + or −15 degrees from true parallel and true perpendicular.

As used herein, the term "about" means that the numerical value is approximate and small variations would not significantly affect the practice of the disclosed embodiments. Where a numerical limitation is used, unless indicated otherwise by the context, "about" means the numerical value can vary by + or −10% and remain within the scope of the disclosed embodiments.

In a further embodiment, the invention also relates to an insert that has an elongate main portion, a first anchor at a proximal end, a second anchor at a distal end, and an elongate branched portion that extends from an intermediate location of the main portion, and includes a third anchor at a distal end of the branched portion, which anchors the branched portion to a sole of a shoe. The insert can be affixed in a cavity of a sole of a shoe as described above, with proximal and distal notches that are configured to receive the proximal and distal anchors of the main and branched portions of the insert. The distal ends of the elongate main portion and branched portion may be located at different positions along the expanse of the sole. For example, the main portion may extend to a toe portion of the sole, while the branched portion may extend only partially along the length of the foot, or vice versa.

In another embodiment the insert may be comprised of a proximal end having a first anchor, a main portion extending from the proximal end, and a distal portion that is comprised of multiple separate branches, each terminating in an anchor at the distal end. The structure and shape of this embodiment is intended to mimic the structure of the plantar fascia ligament, which originates at the heel and branches out toward the toes. A sole that contains this type of elongate element may provide additional support to the user's plantar fascia, to reduce stress on the ligament during use of the footwear. The main portion can be shaped to have a width or circumference that is greater in the main portion than in each of the several branches so as to provide additional support under the hell and/or arch area of the foot. The insert of this invention can be attached to a sole by placing the anchors in corresponding notches in the sole, such as described above with respect to the first embodiment. This way, the insert cannot move longitudinally within the sole during use, but can be stretched when force is applied to the sole. When the force is removed, the inserted is restored to its original shape, and this restorative force can aid the wearer of the footwear during locomotion.

BRIEF DESCRIPTION OF THE DRAWINGS

Embodiments of the present disclosure are described herein with reference to the accompanying drawings, wherein.

DETAILED DESCRIPTION OF THE EMBODIMENTS

Figure 1:
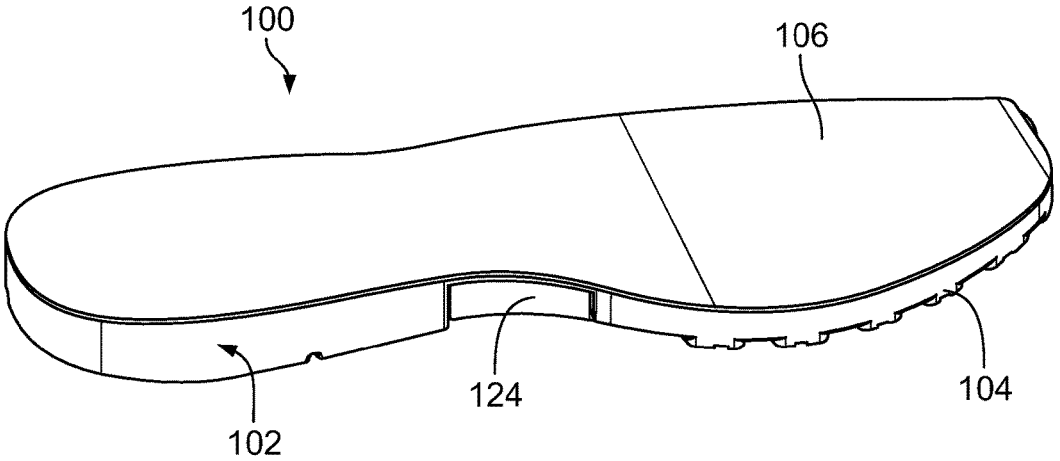
FIG. 1 is a top perspective view illustrating a shoe sole including an innersole, a midsole, and an outer sole.

Embodiments of the presently disclosed soles for footwear are described in detail with reference to the drawings, in which like reference numerals designate identical or corresponding elements in each of the several views. As used herein and as is traditional, the term "distal" will refer to that portion of the sole which is further from the heel/rear (i.e., closer to the toe/front) while the term "proximal" will refer to that portion of the sole which is closer to the heel/rear (i.e., further from the toe/front).

The present disclosure provides embodiments of a sole assembly of footwear, such as, for example, an athletic shoe. The sole assembly includes a midsole and a plurality of flexible inserts configured for removable receipt in the midsole and for absorbing and storing energy as the sole assembly is bent at heel strike, midstance and toe off, and returning the energy to the wearer during and just following these phases of the gait cycle. The plurality of flexible inserts each include anchor ends and an elongate main portion disposed between the anchor ends. The anchor ends are configured to mimic bone by being rigid and securing the inserts to the midsole, and the elongate main portion is configured to mimic muscle by being elastic. The midsole may have a hollow middle portion below which a wearer's foot arch is supported. The elongate main portion of the inserts extend across the hollow interior to freely axially stretch and compress during use. It is contemplated that the elongate main portion of each of the inserts is a bundle of elastic fibers (e.g., wound nylon fibers) or solid elastic material. These and other features and advantages of the various embodiments of the disclosed footwear will be described below.

With reference to FIGS. 1-4, a first exemplary embodiment of a sole assembly of a footwear, such as, for example, an athletic shoe, is illustrated and is generally designated 100. While only the sole assembly 100 is illustrated, it is contemplated that the present disclosure is also directed to a shoe that incorporates the sole assembly 100 described herein, as well as to the individual inserts within the sole assembly. The sole assembly 100 generally includes a midsole 102, an outer sole 104 formed with or otherwise attached to a lower surface of the midsole 102, and an innersole 106 detachably supported on an upper surface of the midsole 102. In aspects, the midsole 102 and outer sole 104 may be monolithically formed as illustrated, and in other aspects the outer sole 104 may be overmolded to or otherwise affixed to the lower surface of the midsole 102.

The midsole 102 is an elongate body fabricated from an elastic material configured to allow for bending of the midsole 102 while being resiliently biased to a generally linear configuration. For example, the midsole 102 may be fabricated from a suitable polymer, such as, for example, polyurethane or ethylene vinyl acetate. Other materials for the midsole 102 are also contemplated, such as, for example, other suitable rubbers, plastics, flexible organic materials, or combinations thereof.

The midsole 102 includes a heel portion 108 or proximal end portion, a toe portion 110 or distal end portion, and an intermediate portion 112 disposed between and formed with the heel and toe portions 108, 110. The intermediate portion 112 defines a cavity 114 or hollow interior. It is contemplated that the cavity 114 may be a vacuum or filled with a gas, liquid, or gel. The midsole 102 has an upper surface 116, a lower surface 118, and first and second lateral side surfaces 120, 122. The upper and lower surfaces 116, 118 and the first and second lateral side surfaces 120, 122 at the intermediate portion 112 may each be fabricated from a transparent material (e.g., clear polyethylene terephthalate glycol or clear polyvinyl chloride), thereby defining a viewing window 124 into the cavity 114 of the midsole 102. It is contemplated that only a portion of the outer surface (e.g., the lateral sides 120, 122 or the upper or lower surfaces 116, 118) of the intermediate portion 112 may be transparent.

The intermediate portion 112 of the midsole 102 defines a plurality of proximal notches 130 and a plurality of distal notches 132 therein. The proximal notches 130 are disposed adjacent the heel portion 108 and proximally of the cavity 114, whereas the distal notches 132 are disposed adjacent the toe portion 110 and distally of the cavity 114. In aspects, the proximal notches 130 may be defined in the heel portion 108, and the distal notches 132 may be defined in the toe portion 110. The proximal notches 130 are substantially aligned with one another in a direction transverse to a longitudinal axis "X" (FIG. 2) defined by the midsole 102, and the distal notches 132 are substantially aligned with one another in the transverse direction. One or more of the proximal notches 130 may be offset in the transverse direction, and one or more of the distal notches 132 may be offset in the transverse direction. The notches 130, 132 may be defined through the upper surface 116 of the midsole 102 and in communication with the cavity 114 to allow for the receipt of a plurality of inserts 140 (FIGS. 2-4), as will be described.

Figure 3:
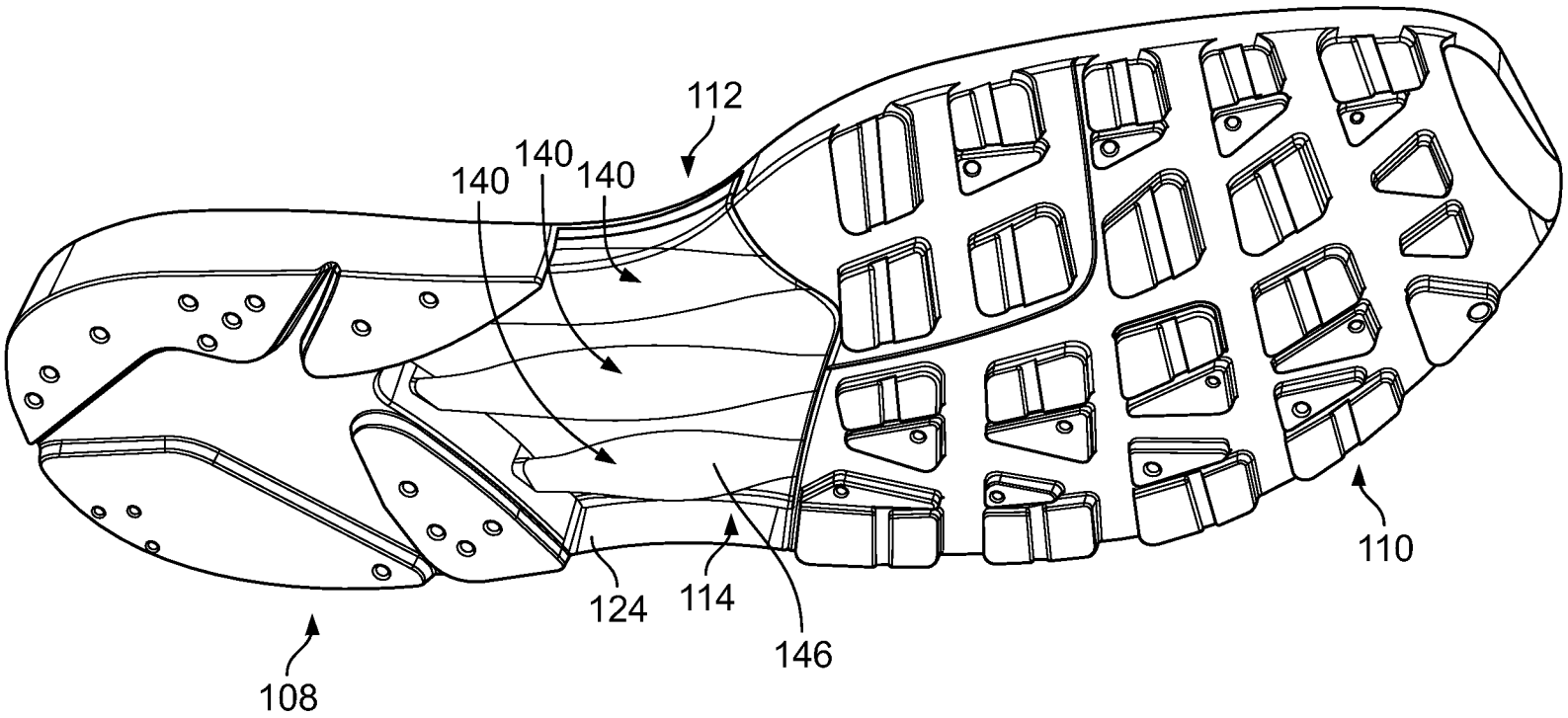
FIG. 3 is a bottom perspective view illustrating the shoe sole of FIG. 1.
Figure 4:
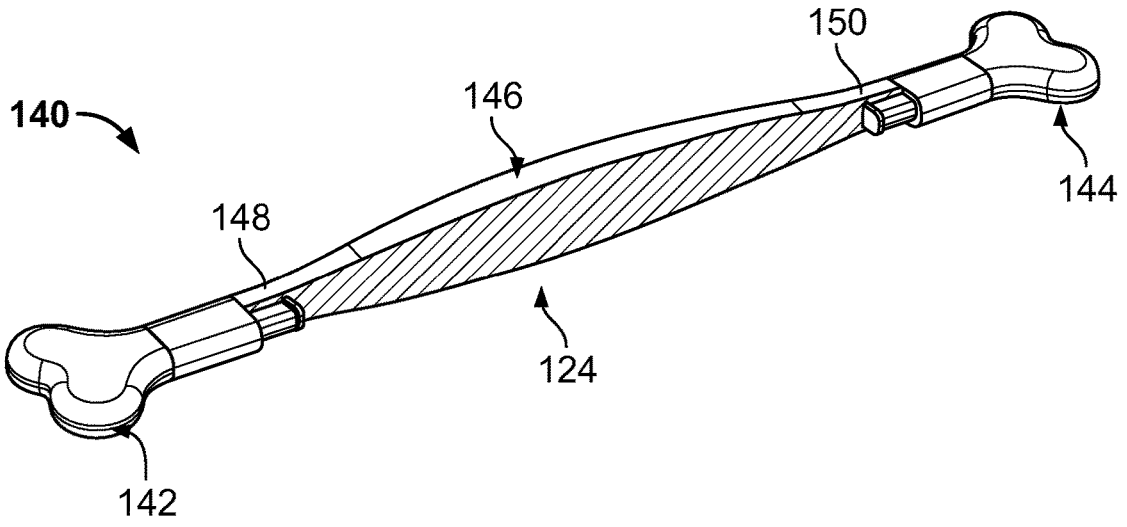
FIG. 4 is a perspective view illustrating a shoe insert of the midsole of FIG. 1.

With reference to FIGS. 3-4, the sole assembly 100 further includes the plurality of inserts 140, such as, for example, a plurality of elastic elongate elements configured for detachable receipt in the midsole 102. The inserts 140 are configured to mimic muscle by storing energy as the sole assembly 100 is flexed during use and releasing the stored energy as the sole assembly 100 returns to it's at-rest state. Since each of the inserts 140 are the same or substantially similar, only one of the inserts 140 will be described in detail herein. It is contemplated that the inserts 140 may differ in length, width, tensile strength, and/or have other different mechanical properties from one another.

The first insert 140 includes a proximal end portion or proximal anchor 142, a distal end portion or distal anchor 144, and an elongate main portion 146 disposed between the proximal and distal anchors 142, 144. In FIG. 4, main portion 146 is shown in cross-section to illustrate the attachment of anchors 142, 144 to main portion 146. The proximal anchor 142 is configured for receipt (e.g., frictional engagement) in a respective proximal notch 130 of the midsole 102, and the distal anchor 144 is configured for receipt (e.g., frictional engagement) in a respective distal notch 132 of the midsole 102. As such, upon engaging the proximal and distal anchors 142, 144 in the respective proximal and distal notches 130, 132, the insert 140 is secured to the midsole 102. In aspects, the anchors 142, 144 may be secured to the midsole 102 via other suitable means, such as, for example, adhesives, hoop and look fasteners, or the like. When the anchors 142, 144 are received in the notches 130, 132, respectively, the notches 130, 132 retain the anchors 142, 144 therein, whereby anchors 142, 144 are prevented from moving axially (e.g., along the longitudinal axis "X" of the midsole 102) relative to the midsole 102. The anchor ends 142, 144 may have a bone shape or any other suitable shape, such as, for example, round, triangular, square, or the like.

The proximal and distal anchors 140, 142 are fabricated from a rigid material, such as, for example, various hard plastics (e.g., polyetheretherketone, acrylic, acetal, polycarbonate, polypropylene, polyvinyl chloride, polypropylene, polycaprolactone), metal (e.g., aluminum, steel, titanium, and alloys thereof), or other suitable materials including hydroxyapatite.

In the embodiment of FIG. 4, the elongate main portion 146 of the insert 140 is more elastic than the proximal and distal anchors 140, 142 and has a first end portion 148 (FIG. 4) and a second end portion 150. The proximal anchor 140 is affixed to the first end portion 148 of the main portion 146, and the distal anchor 142 is affixed to the second end portion 150 of the main portion 146. The anchors 140, 142 may be fixed to the main portion 146 via any suitable fastening engagement including overmolding, adhesives, fasteners, friction-fit engagement, or the like. The main portion 146 spans or extends longitudinally across the cavity 114 of the midsole 102 when the insert 140 is attached to the midsole 102. The inserts 140 are parallel with one another and the longitudinal axis "X" defined by the midsole 102 when the inserts 140 inserted into the midsole 102. In aspects, the inserts 140 may be coplanar or reside on different longitudinal planes of the midsole 102 when inserted into the midsole 102.

The main portion 146 of the insert 140 is fabricated from an elastomer or a rubber. The main portion 146 may include a gridwork of nylon; graphite fibers; fiber reinforced materials, such as carbon and boron based fibrous materials; or reinforced or unreinforced thermoplastic and thermosetting polymers. The elongate main portion 146 may include a bundle of elongate fibers enclosed in a flexible sheath.

To assemble the sole assembly 100, one or more inserts 140 may be selected based on their length, tensile strength, or other mechanical properties, and inserted into the midsole 102. In particular, the proximal and distal anchors 142, 144 of the insert 140 are pushed into the respective proximal and distal notches 130, 132 of the midsole 102 to detachably engage the insert 140 in the midsole 102. Additional inserts 140 may also be attached to the midsole 102.

With the inserts 140 received in the midsole 102, the elongate main portions 146 thereof extend through the cavity 114 and bend, stretch, and/or expand freely during use of the midsole 102 by a wearer. For example, with the midsole 102 fixed within an athletic shoe, as the shoe bends during walking or running, the intermediate portion 112 is bent, whereby the heel and toe portions 108, 110 of the midsole 102 move relative to one another. The proximal and distal anchors 142, 144 of the insert 140 also move relative to one another due to the anchors 142, 144 being fixed relative to the midsole 102. As the proximal and distal anchors 142, 144 move relative to one another, the elongate main portion 146 stretches/lengthens from its natural, unbiased state. As the wearer begins to lift their foot from the ground, the elongate main portion 146 is allowed to return to its natural, unbiased/unstretched state during which the elongate main portion 146 transitions the midsole 102 toward its natural, linear state, thereby assisting the wearer in propelling forward.

Figure 5:
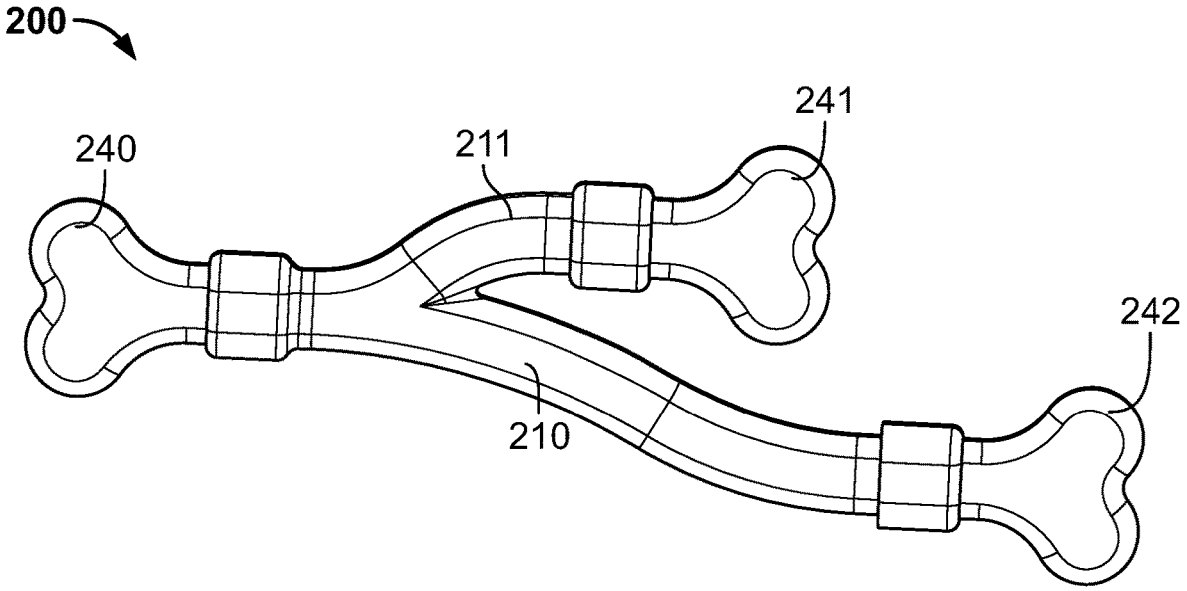
FIG. 5 is a view of an alternative embodiment of the insert.

Additional embodiments of the invention are shown in FIGS. 5-8. FIG. 5 shows an embodiment where insert 200 has a proximal anchor 240, a main portion 210 and a branched portion 211 that extends from the main portion 210. Main portion 210 has a distal end that terminates in a distal anchor 241, and branched portion 211 has a distal end that terminates in distal anchor 242. Branched portion 211 terminates at a shorter distance from proximal anchor 240 than main portion 210. However, the length of each of the portions 210, 211 can be adjusted based on the desired support and shoe type. In this embodiment, the anchors 240, 241, 242 and the main portion 210 and branched portion 211 are formed of a unitary body, with an elastic covering 230 over the main portion 210 and branched portion 211 to provide extra support or cushioning. In this embodiment, the unitary body is formed of a material that sufficiently rigid to keep the anchors in place in the sole, but has some elasticity to allow for stretching of the elongate element during use. The cover 230 can be made of a different material that can impart additional structure or cushioning to the elongate element 200, such as an elastomer or rubber. However, it is also possible that the anchors 240, 241, 242 can be formed of a rigid material with the main and branched portions 210, 211 being made for a more elastic material, as with the embodiments of FIGS. 1-4.

Figure 6:
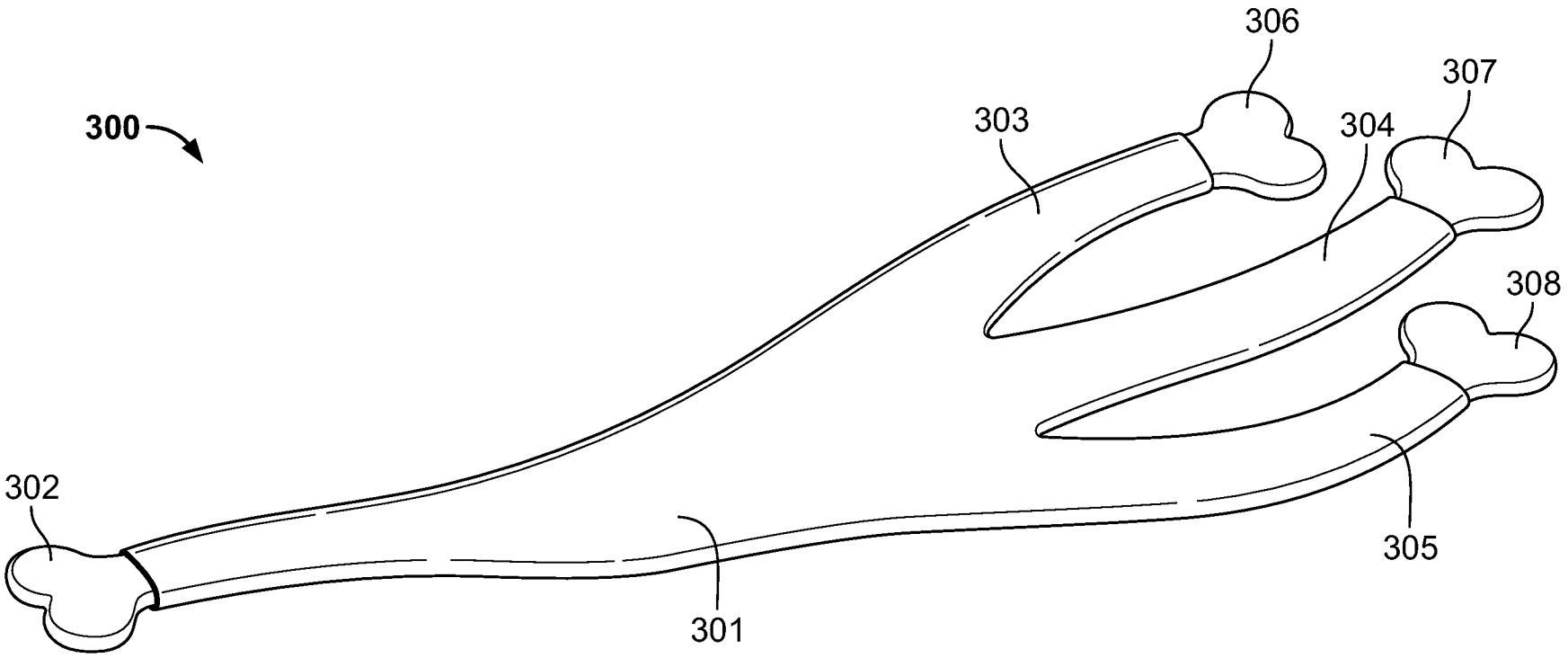
FIG. 6 is a view of another alternative embodiment of the insert.
Figure 7:
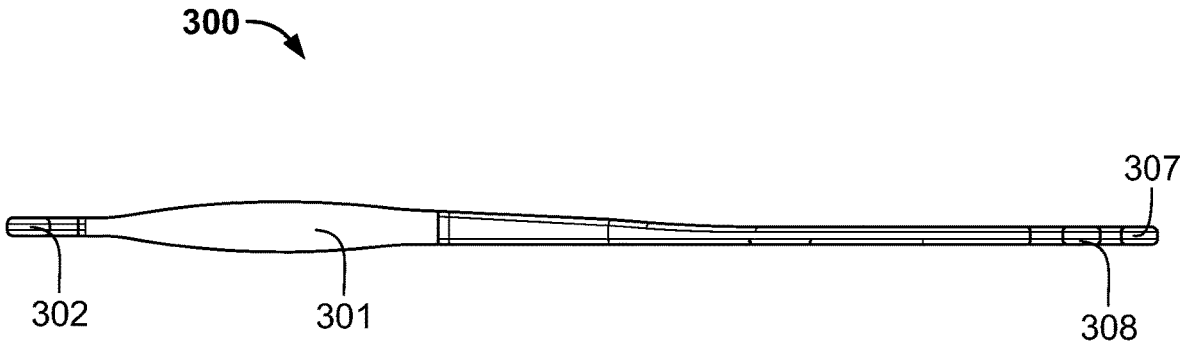
FIG. 7 is a planar cross-sectional view of the insert of FIG. 6.
Figure 8:
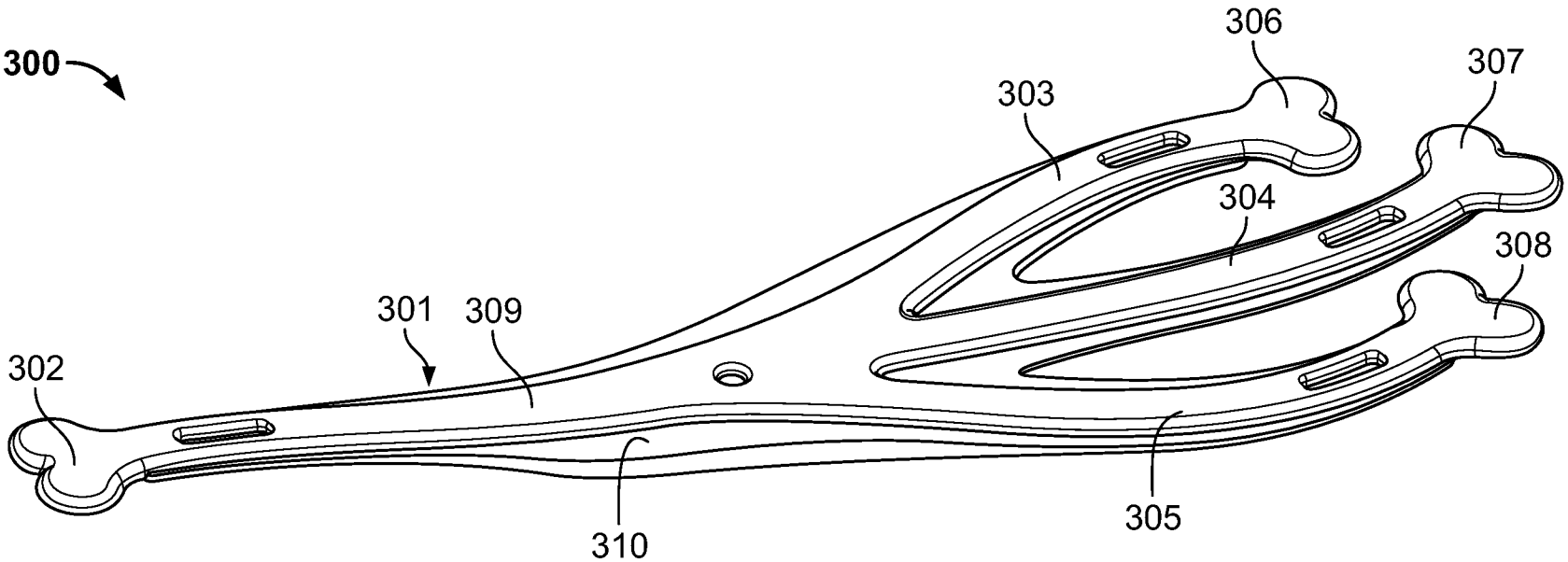
FIG. 8 is a view of the insert of FIG. 6 overlaid on the anatomy of a foot.

FIGS. 6-8 show another embodiment of the invention, where a single elongate element 300 has a main portion 301, a proximal end ending in an anchor 302 and several branched portions 303, 304, and 305, ending in anchors 306, 307 and 308, respectively. As shown in FIG. 8, which shows a lateral cross-section of the insert 300, the insert is formed of a one-piece unitary body 309 in which the main portion 301 is covered by a covering 310. Unitary body 309 can be formed of a semi-rigid material that may or may not stretch or flex under pressure but is rigid enough so that the anchors can be fixed in notches a sole such as sole 100 described with respect to FIGS. 1-4. As shown in the side view of FIG. 7, the proximal end of the insert 300 can be wider or thicker than each of the branched portions 303, 304, 305. Each of the branched portions 303, 304, 305 can be made to be a different length, and in particular, the central branched portion 304 can be longer than the adjacent portions 303 and 305. Covering 310 can be formed of a flexible elastomer, rubber, or any other suitable material to provide cushioning and/or additional support to the wearer's foot. Alternatively, anchor 300 can be formed similar to anchor 140 with respect to FIGS. 1-4, with a main body formed of elastomer connected to rigid anchors.

Figure 2:
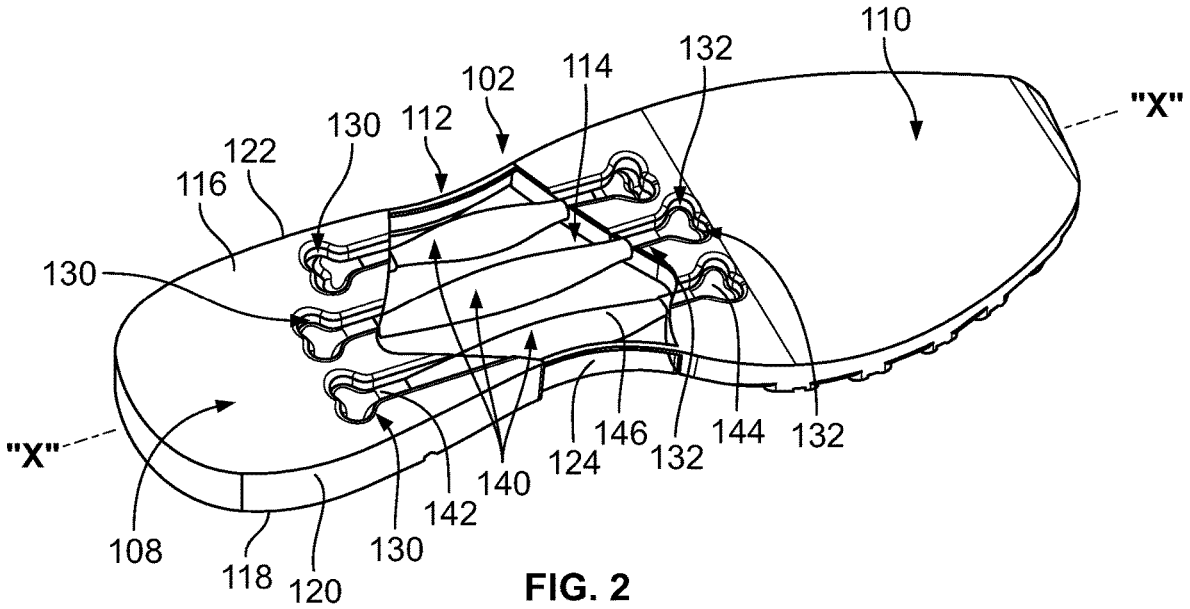
FIG. 2 is a top perspective view illustrating the shoe sole of FIG. 1 with the innersole removed.
Figure 9:
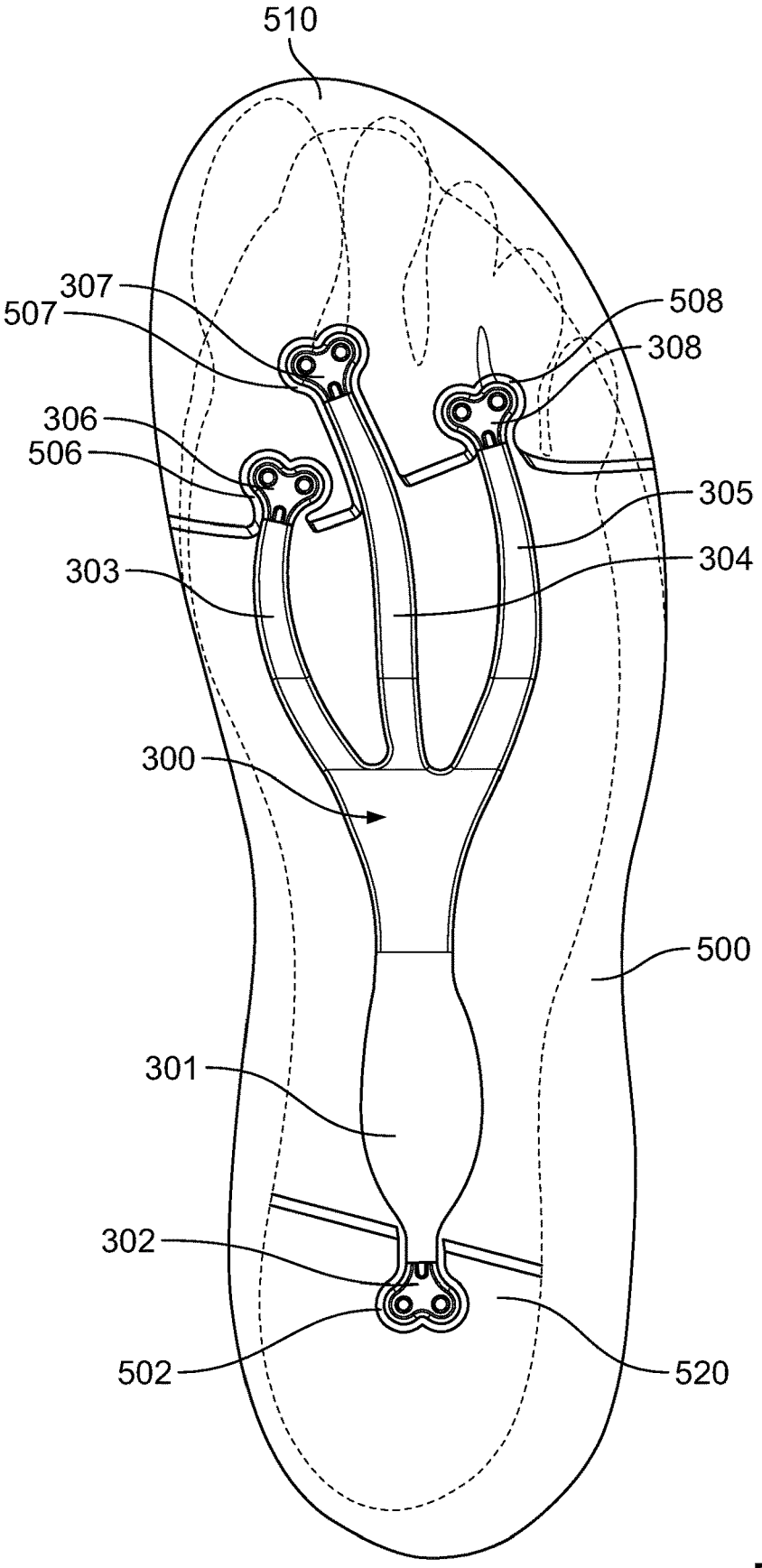
FIG. 9 is a view of the insert of FIG. 6 in a sole of a shoe.

As shown in FIG. 9, which shows the insert 300 in place overlaid on the anatomy of a foot 520 shown in broken lines, the shape of insert 300 is selected to as to follow the shape of a plantar fascia ligament. Use of insert 300 can relieve stress on the ligament by providing additional support to the ligament during use and adds a unique appearance to a shoe when the insert 300 is visible through the bottom or side of the shoe, such as shown in FIGS. 1 and 2. As shown in FIG. 9, anchors 302, 306, 307 and 308 are held securely in proximal notch 502, in proximal portion 509 of sole 500 and in distal notches 506, 507 and 508 in distal portion 510 of sole 500 to prevent relative axial movement of the insert 300 during use. Main portion 301 with branches 303, 304 and 305 extends across cavity 511 of sole 500 and can be seen from the underside of sole 500, which may be formed of transparent material, or from a side view if a window is provided such as shown in FIG. 1. When the user exerts pressure on the foot, such as during the strike of a running step, the main portion 301 can provide additional support to the ligament to prevent over-stretching of the ligament, but the main portion 301 also stretches to some extent, being held securely in notches 502, 506, 507 and 508. Then, when the force of the foot strike has ended, the main portion 301 contracts back to its original shape, providing additional restorative force to aid in locomotion.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended thereto.

What is claimed is:

1. A sole for footwear comprising:

an elongate body that extends in a longitudinal direction, and having a heel portion, a toe portion, and an intermediate portion disposed between the heel and toe portions and an insert in the form of an elongate element, the insert comprising:

an elongate main portion fabricated from an elastic material and having a first end portion and a second end portion;

a first anchor attached to the first end portion of the elongate main portion and configured to detachably engage the elongate body, the first anchor having a free end that is wider than an end attached to the first end portion; and a second anchor attached to the second end portion of the elongate main portion and configured to detachably engage the elongate body, the second anchor having a free end that is wider than an end attached to the second end portion, wherein the insert is connected to the elongate body via said first and second anchors, wherein the intermediate portion of the elongate body defines a proximal notch therein having a proximal end that is wider than a distal end, and a distal notch therein having a distal end that is wider than a proximal end, the first anchor being configured for removable receipt in the proximal notch with the free end received in the proximal end of the proximal notch, and the second anchor being configured for removable receipt in the distal notch with the free end of the second anchor being received in the distal end of the distal notch, so that the first anchor is configured for a friction-fit engagement with the proximal notch, and the second anchor is configured for a friction-fit engagement with the distal notch so as to prevent movement of the anchors in the longitudinal direction relative to the insert.

2. The sole according to claim 1, wherein the first and second anchors are fabricated from a rigid material.

3. The sole according to claim 2, wherein the elastic material of the main portion is an elastomer or rubber, and the rigid material is a metal or a plastic.

4. The sole according to claim 3, wherein the elongate main portion includes a bundle of elongate fibers.

5. The sole according to claim 1, further comprising a branched portion extending from the main portion and ending in an end portion connected to a third anchor.

6. The sole according to claim 1, wherein the anchors and the main portion are formed of a unitary one-piece body and the main portion is covered in a covering formed of a material that is different from a material of the unitary one-piece body.

7. The sole according to claim 6, wherein the covering is formed of mesh or contains embedded fibers.

8. The sole according to claim 1, wherein the second end portion of the main portion forms several branched portions extending from the first end portion of the main portion, with each one of the branches connected to a second anchor.

9. The sole according to claim 8, wherein at least one of the branched portions has a different length that the other of the branched portions.

10. The sole according to claim 1, wherein the insert is parallel with a longitudinal axis defined by the elongate body.

11. The sole according to claim 1, wherein the elongate body has a an upper surface, a lower surface and a lateral side, the lateral side defining a window in the intermediate portion, wherein the lateral side defining the window is formed from a transparent material.

12. The sole according to claim 1, further comprising an additional insert configured to be secured to the elongate body, wherein the inserts extend longitudinally along the elongate body and parallel with one another.

13. The sole according to claim 1, wherein the insert further comprises a branched portion extending from the main portion and ending in an end portion connected to a third anchor.

14. The sole according to claim 1, wherein the second end portion of the main portion forms several branched portions extending from the first end portion of the main portion, with each one of the branches connected to a second anchor.

15. The insert according to claim 14, wherein at least one of the branched portions has a different length that the other of the branched portions.

* * * * *